US012577956B2

(12) United States Patent
Isaji

(10) Patent No.: US 12,577,956 B2
(45) Date of Patent: Mar. 17, 2026

(54) PUMP DEVICE

(71) Applicant: NIDEC INSTRUMENTS CORPORATION, Nagano (JP)

(72) Inventor: Naoya Isaji, Nagano (JP)

(73) Assignee: NIDEC INSTRUMENTS CORPORATION, Nagano (JP)

( * ) Notice: Subject to any disclaimer, the term of this patent is extended or adjusted under 35 U.S.C. 154(b) by 0 days.

(21) Appl. No.: 18/925,021

(22) Filed: Oct. 24, 2024

(65) Prior Publication Data

US 2025/0146503 A1 May 8, 2025

(30) Foreign Application Priority Data

Oct. 31, 2023 (JP) ..... 2023-186451

(51) Int. Cl.

| | |
|---|---|
| ***F04D 29/046*** | (2006.01) |
| ***F04D 1/00*** | (2006.01) |
| ***F04D 13/02*** | (2006.01) |
| ***F04D 13/06*** | (2006.01) |
| ***F04D 25/02*** | (2006.01) |

(Continued)

(52) U.S. Cl.

CPC ..... *F04D 29/046* (2013.01); *F04D 13/06* (2013.01); *F04D 1/00* (2013.01); *F04D 13/024* (2013.01); *F04D 13/027* (2013.01); *F04D 13/0613* (2013.01); *F04D 13/064* (2013.01); *F04D 25/026* (2013.01); *F04D 25/0606* (2013.01); *F04D 25/064* (2013.01); *F04D 29/26* (2013.01); *F04D 29/42* (2013.01)

(58) Field of Classification Search

CPC . F04D 1/00; F04D 1/04; F04D 13/024; F04D 13/026; F04D 13/027; F04D 13/06; F04D 13/0613; F04D 13/064; F04D 13/0673; F04D 25/026; F04D 25/06; F04D 25/0606; F04D 25/0613; F04D 25/0633; F04D 25/064; F04D 29/046; F04D 29/18; F04D 29/20; F04D 29/22; F04D 29/26; F04D 29/28; F04D 29/42; F04D 29/62

See application file for complete search history.

(56) References Cited

U.S. PATENT DOCUMENTS

| | | | | |
|---|---|---|---|---|
| 10,291,091 | B2 * | 5/2019 | Moritz | H02K 5/225 |
| 2011/0027112 | A1 * | 2/2011 | Negishi | H02K 5/1282 417/423.12 |

(Continued)

FOREIGN PATENT DOCUMENTS

| | | | |
|---|---|---|---|
| JP | 2022183753 | A | 12/2022 |

*Primary Examiner* — Binh Q Tran

(74) *Attorney, Agent, or Firm* — HAUPTMAN HAM, LLP

(57) ABSTRACT

A pump device includes a motor having a rotor and a stator, and an impeller which is disposed in a pump chamber and is integrally rotated with the rotor. The rotor includes a rotor member having a first cylindrical part and a drive magnet surrounding the first cylindrical part. A radial bearing is held on an inner side of the first cylindrical part. The drive magnet has a second cylindrical part surrounding an outer periphery of the first cylindrical part and a ring-shaped rib which protrudes from an end of the second cylindrical part to an inner side. The rotor member has a seat part, which protrudes from the first cylindrical part to an outer side and supports an end of the second cylindrical part, and a caulked part which is enlarged from the first cylindrical part to an outer side and is overlapped with the ring-shaped rib.

9 Claims, 9 Drawing Sheets

(51) Int. Cl.

| | |
|---|---|
| ***F04D 25/06*** | (2006.01) |
| ***F04D 29/26*** | (2006.01) |
| ***F04D 29/42*** | (2006.01) |

(56) References Cited

U.S. PATENT DOCUMENTS

| | | | | |
|---|---|---|---|---|
| 2017/0058915 | A1* | 3/2017 | Liang | F04D 13/06 |
| 2020/0321828 | A1* | 10/2020 | Mills | F04B 17/03 |
| 2021/0180610 | A1* | 6/2021 | Hueser | F04D 13/0686 |
| 2022/0003237 | A1* | 1/2022 | Ehlers | F04D 29/0563 |
| 2023/0287893 | A1* | 9/2023 | Oniduka | H02K 7/09 |

* cited by examiner

PUMP DEVICE

CROSS REFERENCE TO RELATED APPLICATION

The present invention claims priority under 35 U.S.C. § 119 to Japanese Application No. 2023-186451 filed Oct. 31, 2023, the entire content of which is incorporated herein by reference.

TECHNICAL FIELD

At least an embodiment of the present invention may relate to a pump device including a rotor which is integrally rotated with an impeller.

BACKGROUND

Japanese Patent Laid-Open No. 2022-183753 (Patent Literature 1) describes a pump device in which an impeller disposed in a pump chamber is rotated by a motor. The motor includes a rotor which is integrally rotated with the impeller. The rotor includes a cylindrical part which holds a radial bearing in a cylindrical shape on its inner side, and a drive magnet in a cylindrical shape is fixed to an outer peripheral side of the cylindrical part. The drive magnet is held between a seat part which projects from the cylindrical part to an outer side in a radial direction and a caulked part which is formed at a tip end of the cylindrical part.

The rotor is rotatably supported by a fixed shaft through a radial bearing. When the rotor is rotated, the radial bearing becomes a high temperature due to friction and the like and the drive magnet also becomes a high temperature by the heat and thus, reduction in a lifetime of components and reduction in magnetic characteristics of the drive magnet may occur. In the pump device described in Patent Literature 1, a fluid of the pump chamber flows through a gap between the drive magnet and the cylindrical part of the rotor to cool the drive magnet.

In the rotor having structure that the drive magnet is held between the seat part and the caulked part provided in the cylindrical part, an end face of the drive magnet is covered by the caulked part. In a case that a thickness in a radial direction of the drive magnet is thin, a width in the radial direction of the end face of the drive magnet is narrow. Therefore, the caulked part may project to an outer peripheral side from the drive magnet to form a burr and thus, shape accuracy of the rotor is likely to reduce.

Further, in the rotor, the radial bearing which is held inside the cylindrical part is pressed against a support member such as a washer in an axial direction by a magnetic attracting force generated by the drive magnet. The drive magnet is required to secure a dimension (volume) capable of generating a magnetic attracting force which is necessary for pressing the radial bearing against the support member. Therefore, a dimension in the axial direction of the drive magnet becomes longer and thus, a dimension in the axial direction of the rotor becomes longer.

In addition, in order to cool the radial bearing and the drive magnet by making a fluid of a pump chamber flow into a gap between the cylindrical part and the drive magnet of the rotor, there is a demand to secure a flow amount for enhancing a cooling effect.

SUMMARY

In view of the problem described above, at least an embodiment of the present invention may advantageously provide a pump device capable of suppressing reduction in shape accuracy of a rotor in a case that a drive magnet is fixed by thermal caulking and capable of reducing a size in an axial direction of the rotor.

Further, at least another embodiment of the present invention may advantageously provide a pump device capable of forming a flow passage with a large flow amount on an inner side of the drive magnet.

According to at least an embodiment of the present invention, there may be provided a pump device including a motor having a rotor and a stator surrounding an outer peripheral side of the rotor, and an impeller which is, when a direction along a rotation axis of the rotor is defined as an axial direction, disposed in a pump chamber provided on one side in the axial direction with respect to the stator and is integrally rotated with the rotor. The rotor includes a rotor member provided with a first cylindrical part extending in the axial direction and a drive magnet surrounding an outer periphery of the first cylindrical part. A radial bearing is held on an inner side of the first cylindrical part. The drive magnet is provided with a second cylindrical part, which surrounds an outer periphery of the first cylindrical part and extends in the axial direction, and a ring-shaped rib which protrudes from an end on the other side in the axial direction of the second cylindrical part to an inner side in a radial direction. The rotor member is provided with a seat part which protrudes from the first cylindrical part to an outer side in the radial direction and supports an end on one side in the axial direction of the second cylindrical part, and a caulked part which is enlarged from an end on the other side in the axial direction of the first cylindrical part to an outer side in the radial direction and is overlapped with the ring-shaped rib from the other side in the axial direction.

According to the embodiment of the present invention, the drive magnet is held between the seat part and the caulked part provided in the first cylindrical part of the rotor member. The drive magnet is provided with the ring-shaped rib which protrudes to an inner side in the radial direction at an end located on a tip end side of the first cylindrical part (caulked part side). As described above, when the drive magnet is provided with a protruding portion (ring-shaped rib) which protrudes to an inner peripheral side instead of forming a simple cylindrical shape, even when a length in the axial direction of the drive magnet is shortened, its volume is secured and a necessary magnetic attracting force can be secured. Further, the ring-shaped rib is provided at an end on a side where the caulked part is provided and thus, a width in the radial direction of an end face which receives the caulked part is large. Therefore, the caulked part is less likely to protrude from the drive magnet to an outer side in the radial direction and thus, reduction in shape accuracy of the rotor due to thermal caulking can be suppressed.

In the present invention, it is preferable that a space in the radial direction is provided between the first cylindrical part and the second cylindrical part, the space functions as a flow path groove in which a fluid of the pump chamber flows, and the flow path groove is closed on the other side in the axial direction by the ring-shaped rib and the caulked part. According to this structure, the flow path groove has a depth (dimension in the radial direction) corresponding to a protruded dimension of the ring-shaped rib and thus, a capacity of the flow path groove can be secured and much fluid can be made flow between the drive magnet and the first cylindrical part. Therefore, a cooling effect of the radial bearing which is held inside the first cylindrical part and a cooling effect of the drive magnet can be enhanced. Accordingly, reduction in a lifetime of the component and reduction in magnetic characteristics of the drive magnet due to a high temperature can be suppressed.

In the present invention, it is preferable that an inner peripheral face of the second cylindrical part is provided in a circumferential direction with a plurality of magnet side ribs which protrude to an inner side in the radial direction and extend in the axial direction, and a space between the magnet side ribs adjacent to each other in the circumferential direction functions as the flow path groove. According to this structure, the first cylindrical part can be fitted to an inner side of the magnet side ribs which are disposed radially and thus, the flow path groove having a large capacity is secured and the drive magnet can be attached with a high degree of accuracy. Further, the second cylindrical part can be reinforced by the magnet side ribs and thus, strength of the drive magnet can be increased.

In the present invention, it is preferable that an end on the other side in the axial direction of the magnet side rib is connected with the ring-shaped rib. According to this structure, the second cylindrical part and the ring-shaped rib are connected with each other through the magnet side ribs and thus, strength of the drive magnet can be increased.

In the present invention, it is preferable that an outer peripheral face of the first cylindrical part is provided in a circumferential direction with a plurality of rotor member side ribs which protrude to an outer side in the radial direction and extend in the axial direction, and a tip end face of the magnet side rib contacts with a tip end face of the rotor member side rib and thereby, the flow path groove is partitioned in the circumferential direction. As described above, when a rib is also formed in the rotor member in addition to the drive magnet, a depth (dimension in the radial direction) of the flow path groove can be further increased. Therefore, a capacity of the flow path groove can be secured.

In the present invention, it is preferable that an inflow port communicating with the flow path groove is provided between the seat part and the second cylindrical part. According to this structure, a fluid of the pump chamber is capable of making flow into the flow path groove through a gap on an outer peripheral side of the drive magnet.

In the present invention, it is preferable that the flow path groove is provided with a first groove part extending in the axial direction, a second groove part extending in the axial direction on a rear side in a rotating direction of the rotor with respect to the first groove part, and a third groove part which extends in a circumferential direction and connects ends on the other side in the axial direction of the first groove part and the second groove part with each other, and the inflow port communicates with the first groove part. According to this structure, the flow path groove is formed so that the first groove part and the second groove part extended in the axial direction are connected with each other through the third groove part in a shape that is turned once (U-shape) in the axial direction. As a result, in comparison with a case that a simple straight-shaped flow passage is provided, an area contacting with a fluid is capable of widening and thus, a cooling effect can be enhanced. Further, when the rotor is rotated, the fluid flows to a rear side in a rotating direction by an inertial force and thus, the inflow port side becomes negative pressure and the fluid of the pump chamber continues to flow in. Therefore, a cooling effect can be enhanced.

In the present invention, it is preferable that the seat part is provided with a recessed part which is recessed to one side in the axial direction, and the inflow port is a gap space between a bottom face of the recessed part and an end face on one side in the axial direction of the second cylindrical part. According to this structure, without providing a through-hole in a component, a flow passage which communicates an outer peripheral side of the drive magnet with its inner peripheral side can be formed with a simple structure.

In the present invention, it is preferable that a first protruded part protruding from the bottom face of the recessed part is fitted to a first recessed part provided on an end face of the drive magnet, and portions of the recessed part on both sides in the circumferential direction of the first protruded part form the inflow ports at two positions. According to this structure, a rotation preventing part for preventing relative rotation of the drive magnet to the rotor member can be provided. Further, an angular position of the inflow port with respect to the drive magnet can be aligned and thus, the inflow port can be provided at an appropriate angular position.

In the present invention, it is preferable that the impeller is provided with a flange part provided at an end on one side in the axial direction of the rotor member and a blade wheel fixed to the flange part from one side in the axial direction, the first cylindrical part is provided with a connection part extending in the axial direction between the flange part and the seat part and a magnet holding part fitted to an inner side of the drive magnet, the radial bearing is held on an inner side of the magnet holding part, an inner side of the connection part is a first space in which a fluid of the pump chamber flows through a through-hole penetrating through the connection part in the radial direction, and the first space communicates with a bearing cooling flow passage which is penetrated through the magnet holding part in the axial direction. According to this structure, a fluid of the pump chamber can be made flow into the bearing cooling flow passage from a position (first space) different from an outer peripheral side of the drive magnet. Therefore, a cooling effect can be enhanced.

Effects of the Invention

According to the present invention, even when a length in the axial direction of the drive magnet is shortened, its volume is secured and a necessary magnetic attracting force can be secured. Further, the ring-shaped rib is provided at an end on a side where the caulked part is provided and thus, a width in the radial direction of an end face which receives the caulked part is large. Therefore, the caulked part is less likely to protrude from the drive magnet to an outer side in the radial direction and thus, reduction in shape accuracy of the rotor due to thermal caulking can be suppressed.

In addition, according to the present invention, the flow path groove having a depth corresponding to a protruded dimension of the ring-shaped rib can be secured on an inner side of the drive magnet and thus, a flow passage having a large flow amount can be formed. Therefore, a cooling effect of the radial bearing which is held on an inner side of the first cylindrical part and a cooling effect of the drive magnet can be enhanced. Accordingly, reduction in a lifetime of the component and reduction in magnetic characteristics of the drive magnet due to a high temperature can be suppressed.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

A pump device 1 in accordance with an embodiment of the present invention will be described below with reference to the accompanying drawings. In the present specification, an axial direction means a direction in which a rotation axis "L" of a motor 10 is extended. One side in the axial direction is referred to as an "L1" and the other side in the axial direction is referred to as an "L2". A radial direction regarding an inner side in the radial direction and an outer side in the radial direction means a radial direction with the rotation axis "L" as a center. A circumferential direction means a rotating direction with the rotation axis "L" as a center.

(Entire Structure)

Figure 1:
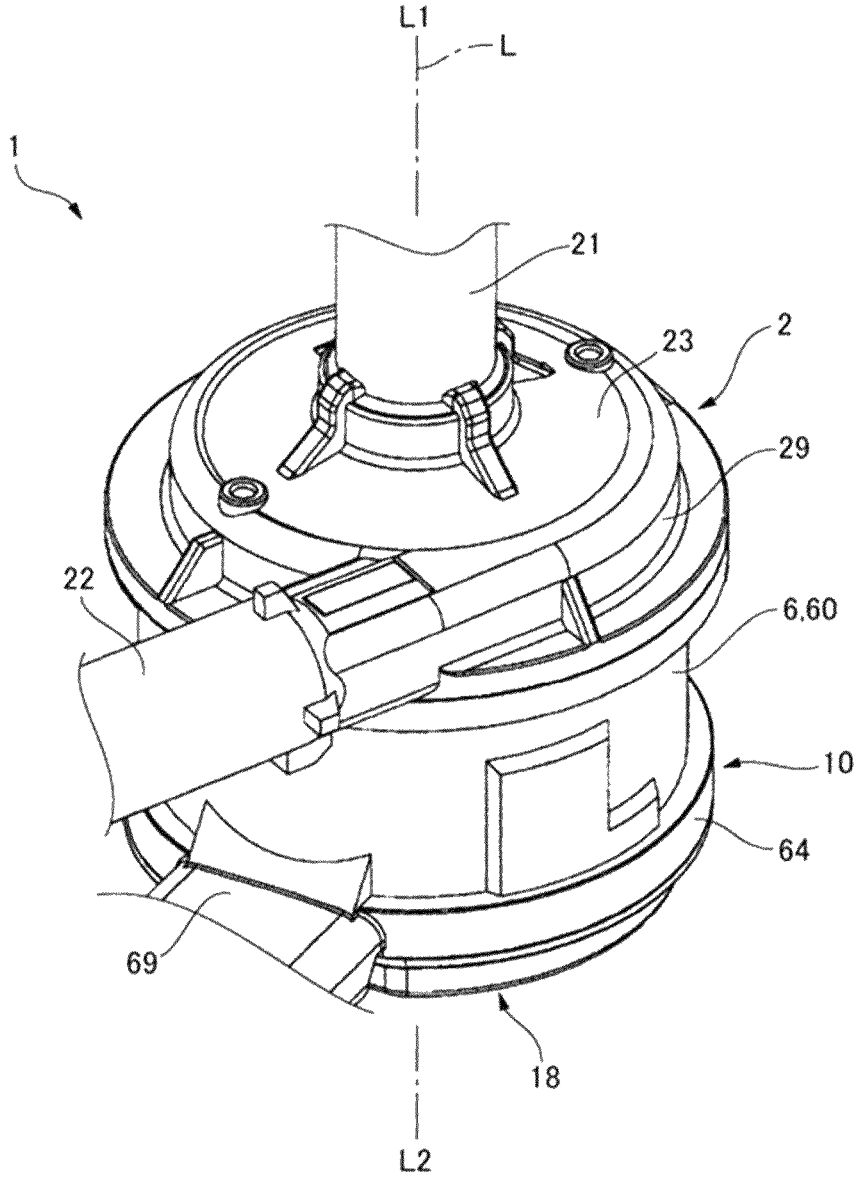
FIG. 1 is an outward appearance perspective view showing a pump device in accordance with an embodiment of the present invention.
Figure 2:
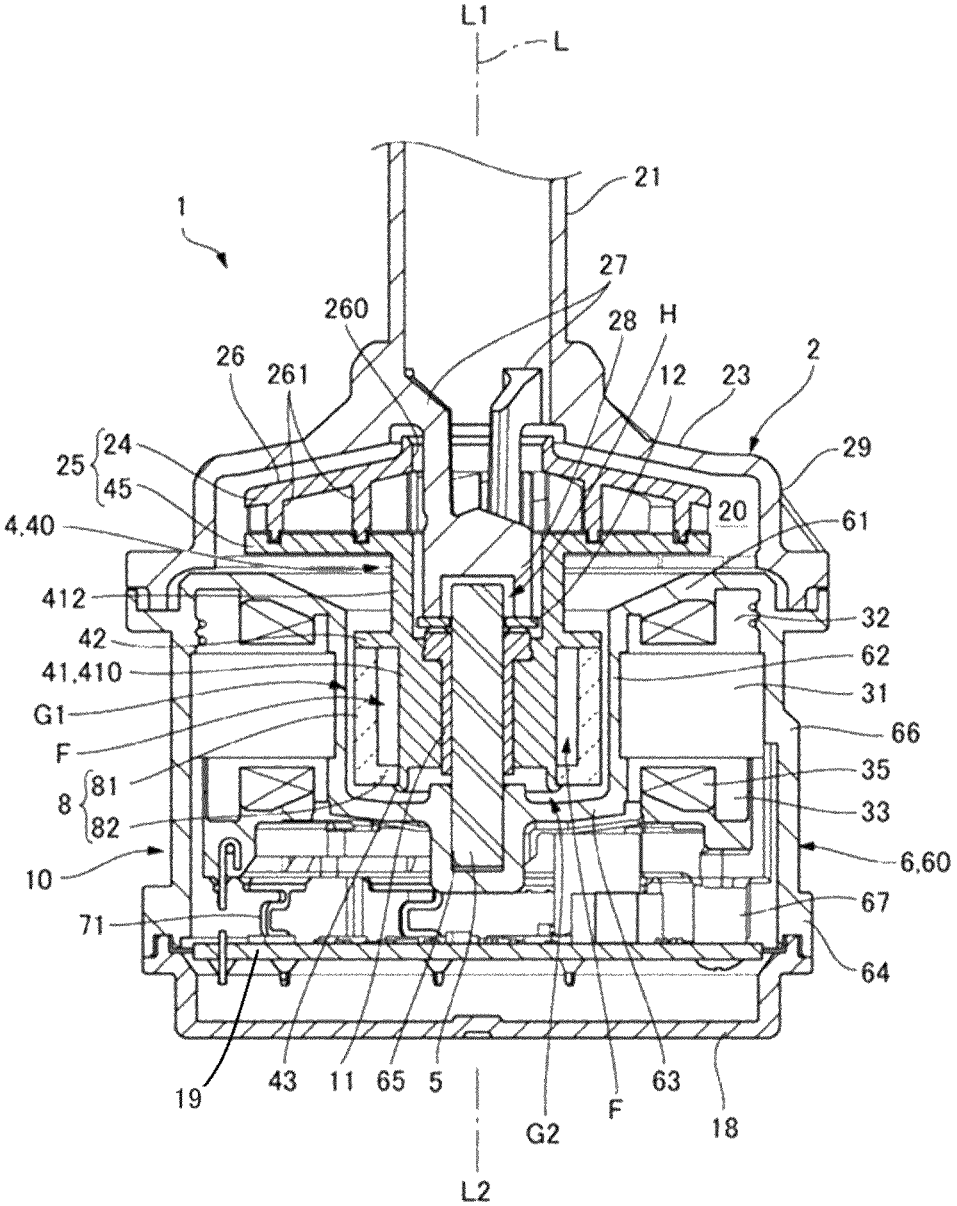
FIG. 2 is a cross-sectional view showing the pump device in FIG. 1 which is cut in a plane including a rotation axis.

FIG. 1 is an outward appearance perspective view showing a pump device 1 in accordance with an embodiment of the present invention. FIG. 2 is a cross-sectional view showing the pump device 1 in FIG. 1 which is cut in a plane including the rotation axis "L". As shown in FIGS. 1 and 2, the pump device 1 includes a case 2 provided with a suction pipe 21 extended to one side "L1" in the axial direction and a discharge pipe 22, a motor 10 which is disposed on the other side "L2" in the axial direction with respect to the case 2, and an impeller 25 which is disposed in a pump chamber 20 inside the case 2. The impeller 25 is rotationally driven around the rotation axis "L" by the motor 10. In the pump device 1 in this embodiment, a fluid flowing through the pump chamber 20 is liquid. The pump device 1 is, for example, used under a condition that an environmental temperature and a fluid temperature are easily changeable.

The motor 10 includes a ring-shaped stator 3, a rotor 4 disposed on an inner side with respect to the stator 3, a support shaft 5 which rotatably supports the rotor 4, and a housing 6 made of resin which covers the stator 3. The support shaft 5 is made of metal or ceramic. The impeller 25 is integrally rotated with the rotor 4. As shown in FIG. 2, in the pump device 1, the impeller 25 and the pump chamber 20 are provided on one side "L1" in the axial direction with respect to the stator 3.

As shown in FIG. 2, the pump chamber 20 is provided between the case 2 and the housing 6. The case 2 is provided with an upper wall 23 which is located on one side "L1" in the axial direction of the pump chamber 20, and a side wall 29 which surrounds an outer periphery of the pump chamber 20 and is extended in the circumferential direction. As shown in FIG. 1, the suction pipe 21 is extended in the axial direction at a center in the radial direction of the case 2. The discharge pipe 22 is extended in a direction perpendicular to the rotation axis "L" of the motor 10 from the side wall 29.

As shown in FIG. 2, the stator 3 includes a stator core 31, an insulator 32 which is overlapped with the stator core 31 from one side "L1" in the axial direction, an insulator 33 which is overlapped with the stator core 31 from the other side "L2" in the axial direction, and a plurality of coils 35 which are wound around a plurality of salient poles provided in the stator core 31 through the insulators 32 and 33. The motor 10 is a three-phase motor. Therefore, a plurality of the coils 35 includes a U-phase coil, a V-phase coil and a W-phase coil.

The rotor 4 includes a rotor member 40 made of resin. The rotor member 40 is provided with a first cylindrical part 41 extended in the axial direction and a flange part 45 which is formed at an end on one side "L1" in the axial direction of the first cylindrical part 41. The first cylindrical part 41 is extended from an inner side in the radial direction with respect to the stator 3 toward the pump chamber 20 and opens in the pump chamber 20. An outer peripheral face of the first cylindrical part 41 holds a drive magnet 8 in a cylindrical shape. The drive magnet 8 faces the stator 3 on an inner side in the radial direction. The drive magnet 8 is, for example, made of a neodymium bonded magnet.

A blade wheel 24 is connected with the flange part 45 of the rotor member 40 from one side "L1" in the axial direction. In this embodiment, the impeller 25 connected with the first cylindrical part 41 of the rotor member 40 is structured of the flange part 45 and the blade wheel 24. The blade wheel 24 is provided with a circular plate part 26 facing the flange part 45 in the axial direction and a plurality of blade parts 261 which are protruded from the circular plate part 26 to the other side "L2" in the axial direction. The blade wheel 24 is fixed to the flange part 45 through the blade parts 261. A center of the circular plate part 26 is formed with a center hole 260. The circular plate part 26 is inclined in a direction toward a side of the flange part 45 as going to an outer side in the radial direction. A plurality of the blade parts 261 is disposed at equal angular intervals. Each of the blade parts 261 is extended to an outer side in the radial direction from a circumference of the center hole 260 while curved in a circular arc shape.

In the rotor member 40, a radial bearing 11 in a cylindrical shape is held on an inner side in the radial direction of the first cylindrical part 41. The rotor 4 is rotatably supported by the support shaft 5 through the radial bearing 11. An end on the other side "L2" in the axial direction of the support shaft 5 is held by a shaft hole 65 formed in a bottom wall 63 of the housing 6. The case 2 is provided with three support parts 27 which are extended from an inner peripheral face of the suction pipe 21 toward the motor 10. The support parts 27 are formed with a cylindrical part 28 which is opened to the other side "L2" in the axial direction, and an end on one side "L1" in the axial direction of the support shaft 5 is held by the cylindrical part 28.

An end on one side "L1" in the axial direction of the support shaft 5 is attached with a thrust bearing 12 in a circular ring shape, and the thrust bearing 12 is disposed between the radial bearing 11 and an end face of the cylindrical part 28. The radial bearing 11 is pressed against the thrust bearing 12 from the other side "L2" in the axial direction by a magnetic attracting force of the drive magnet 8. In this embodiment, at least parts of an end on the other side "L2" of the support shaft 5 and the shaft hole 65 are formed into a "D"-shape in cross section. Further, each of an end on one side "L1" of the support shaft 5 and a hole of the thrust bearing 12 is formed into a "D"-shape in cross section. Therefore, rotation of the support shaft 5 and the thrust bearing 12 with respect to the housing 6 is prevented.

The housing 6 is a resin sealing member 60 which covers the stator 3 from both sides in the radial direction and from both sides in the axial direction. The resin sealing member 60 is made of polyphenylene sulfide (PPS). The stator 3 is integrally formed with the resin sealing member 60 by insert molding. The housing 6 is a partition member provided with a first partition part 61 which faces the upper wall 23 covering one side "L1" in the axial direction of the pump chamber 20, a second partition part 62 disposed between the stator 3 and the drive magnet 8, and a bottom wall 63 which is provided at an end on the other side "L2" of the second partition part 62. Further, the housing 6 is provided with a body part 66 in a cylindrical shape which covers the stator 3 from an outer side in the radial direction.

As shown in FIGS. 1 and 2, an end 64 on the other side "L2" in the axial direction of the housing 6 is fixed with a cover 18 from the other side "L2" in the axial direction. As shown in FIG. 2, a board 19 provided with a circuit which controls power feeding to the coils 35 is disposed between the cover 18 and the bottom wall 63 of the housing 6. The board 19 is connected by solder with coil terminals 71 made of metal which are penetrated through the bottom wall 63 of the housing 6 from the stator 3 and protruded to the other side "L2" in the axial direction. The housing 6 is provided with a pillar-shaped part 67 which protrudes from the bottom wall 63 to the other side "L2" in the axial direction. The board 19 is fixed to the pillar-shaped part 67 with a screw.

As shown in FIG. 1, the housing 6 is provided with a connector housing 69 in a tube shape which is extended from the body part 66 surrounding an outer peripheral side of the stator 3 to an outer side in the radial direction. An inside of the connector housing 69 is arranged with connector terminals whose one ends are connected with the board 19. When a connector is connected with the connector housing 69, drive electric currents generated in the circuit mounted on the board 19 are supplied to the respective coils 35 through the coil terminals 71. As a result, the rotor 4 is rotated around the rotation axis "L" of the motor 10. Therefore, the impeller 25 is rotated in an inside of the pump chamber 20 and the inside of the pump chamber 20 becomes negative pressure and thus, a fluid is sucked into the pump chamber 20 through the suction pipe 21 and is discharged from the discharge pipe 22.

(Holding Structure of Drive Magnet and Radial Bearing)

Figure 3:
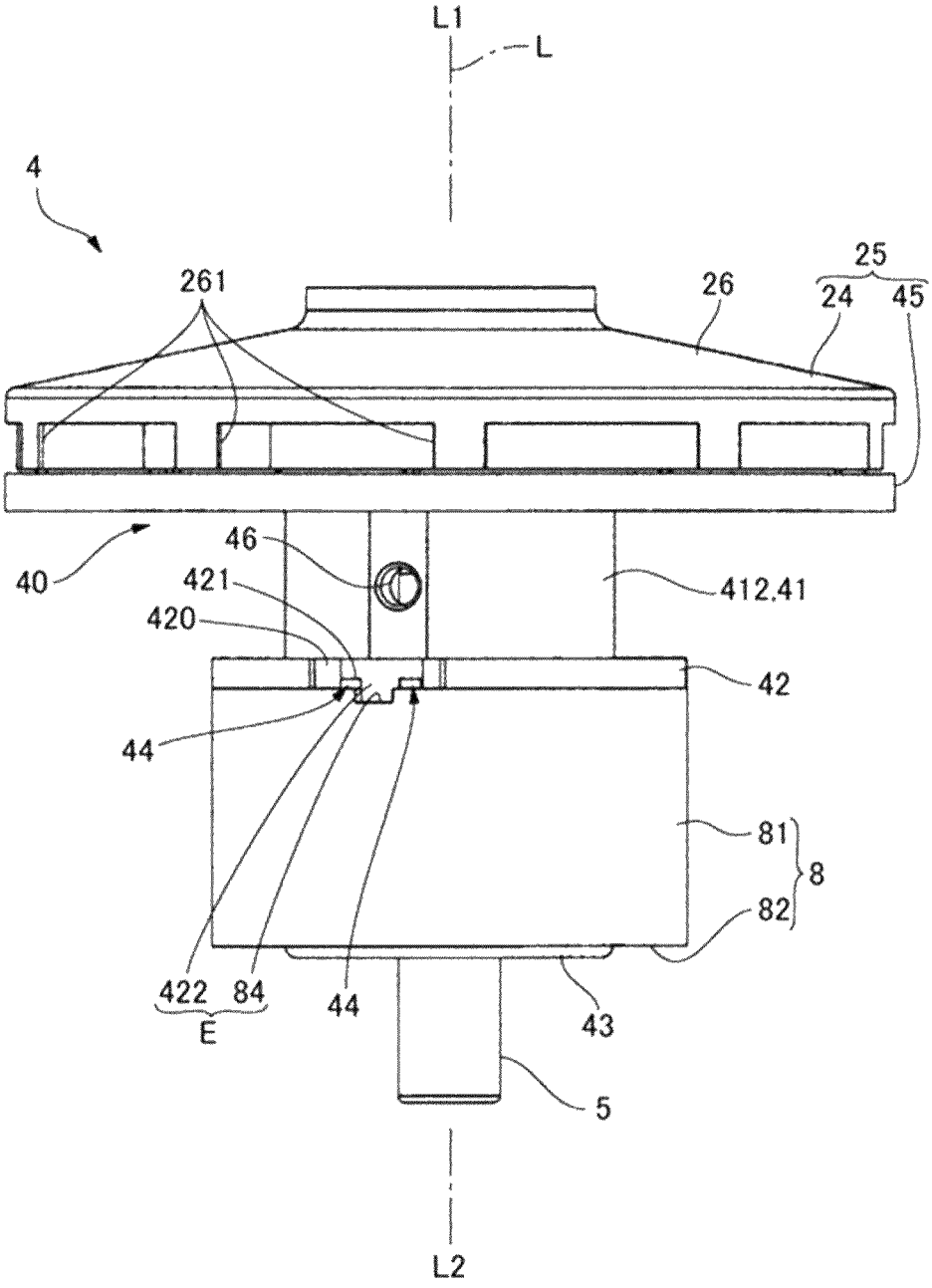
FIG. 3 is a side view showing a rotor.
Figure 4:
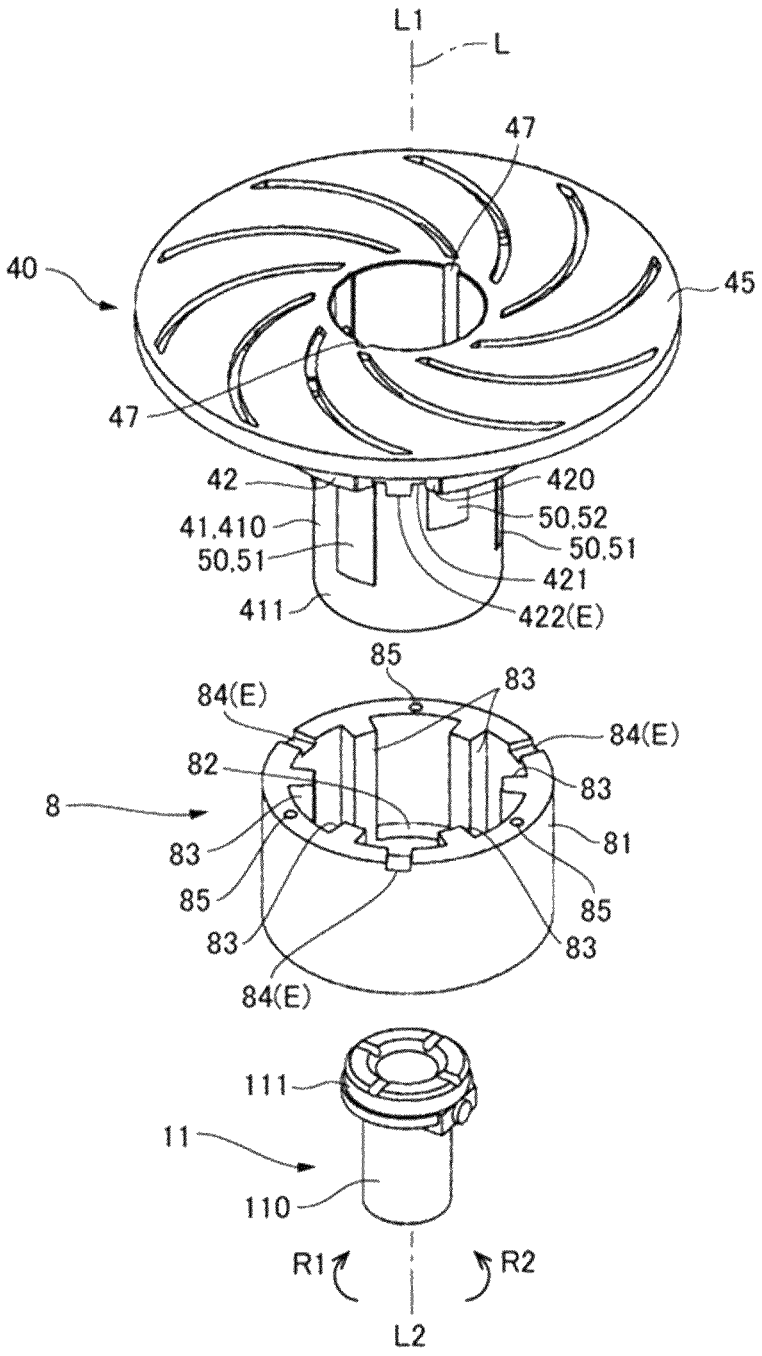
FIG. 4 is an exploded perspective view showing a rotor and a radial bearing which are viewed from one side in an axial direction.
Figure 5:
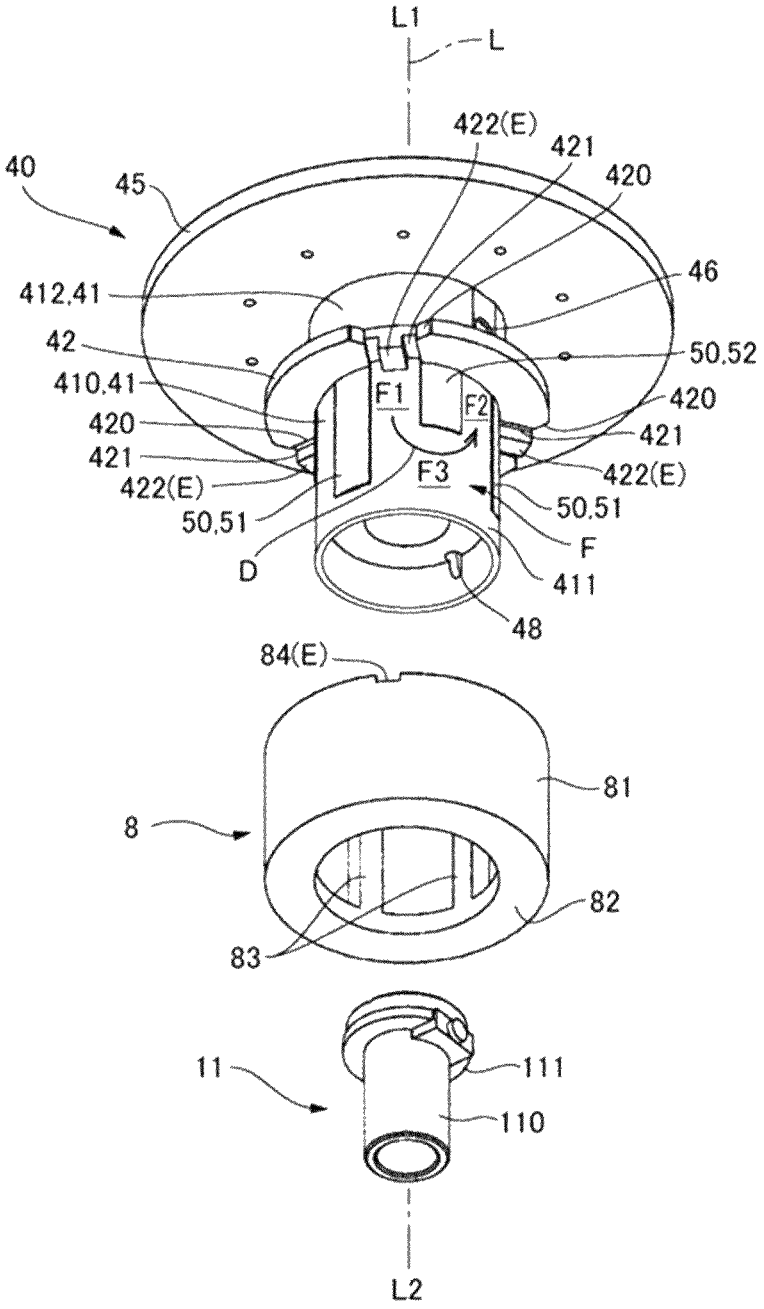
FIG. 5 is an exploded perspective view showing the rotor and the radial bearing which are viewed from the other side in the axial direction.
Figure 6:
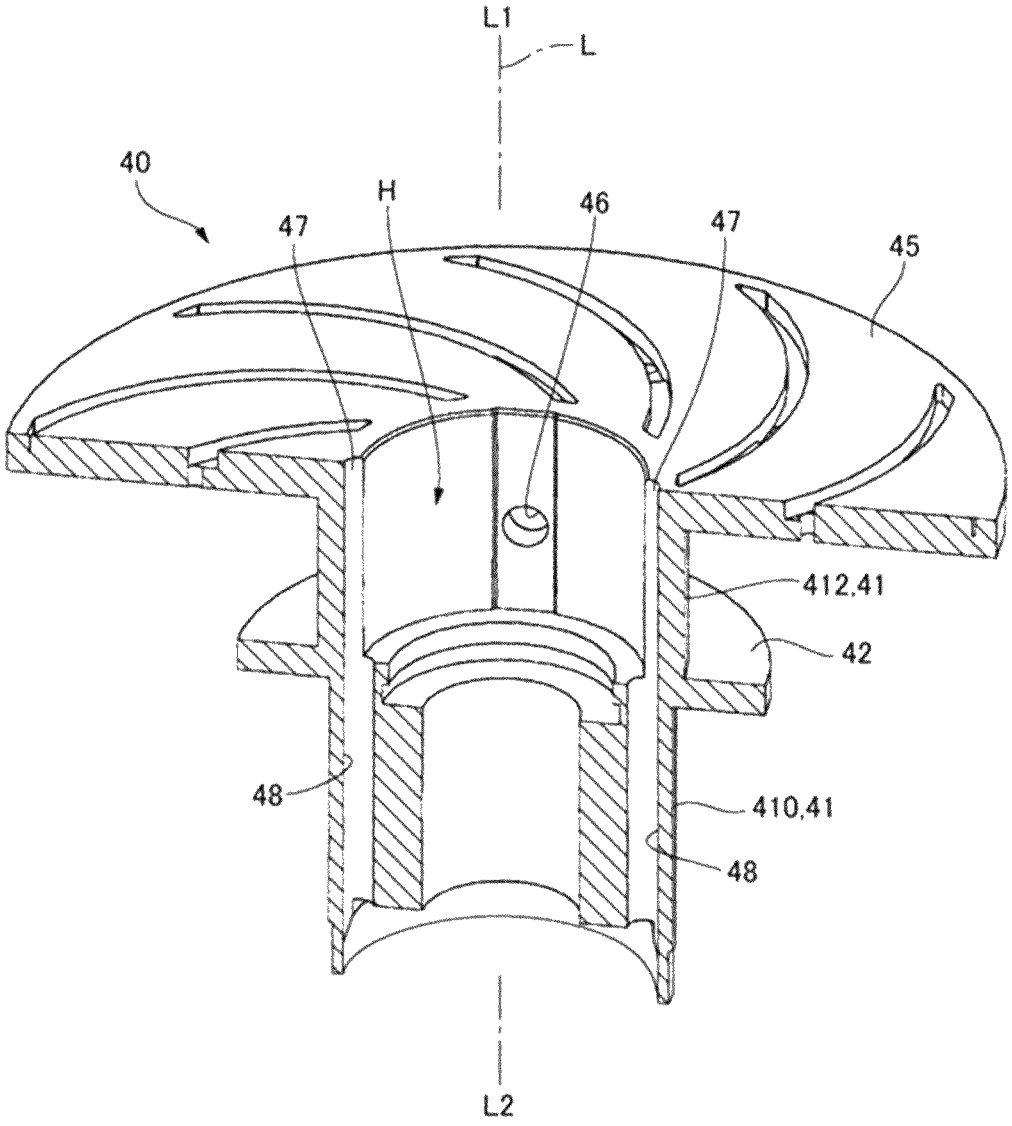
FIG. 6 is a cross-sectional perspective view showing a rotor member.
Figure 7:
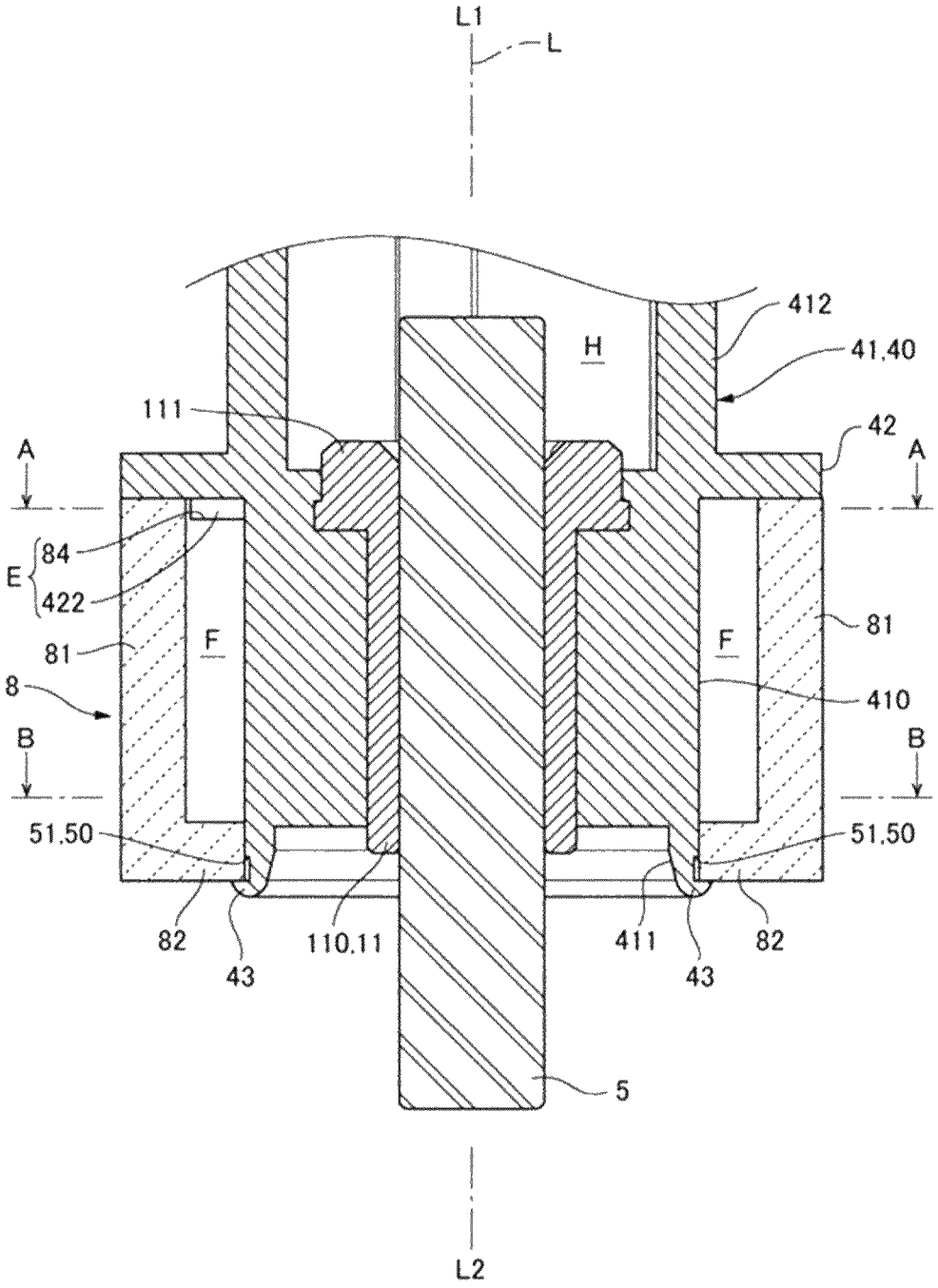
FIG. 7 is a partial cross-sectional view showing the rotor, the radial bearing and a support shaft which are cut in a plane including a rotation axis.
Figure 8:
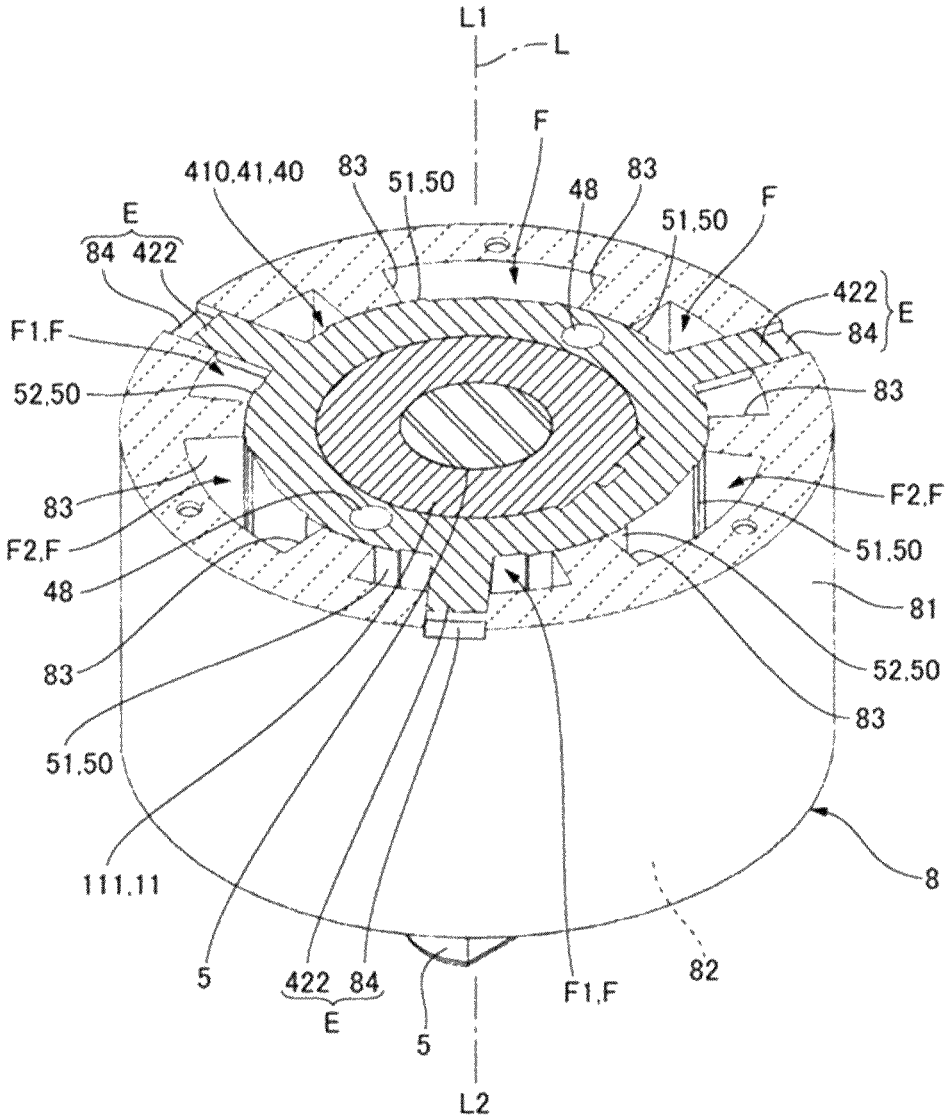
FIG. 8 is a cross-sectional perspective view showing the rotor, the radial bearing and the support shaft which are cut in a plane perpendicular to the rotation axis (view which is cut at the "A-A" position in FIG. 7).
Figure 9:
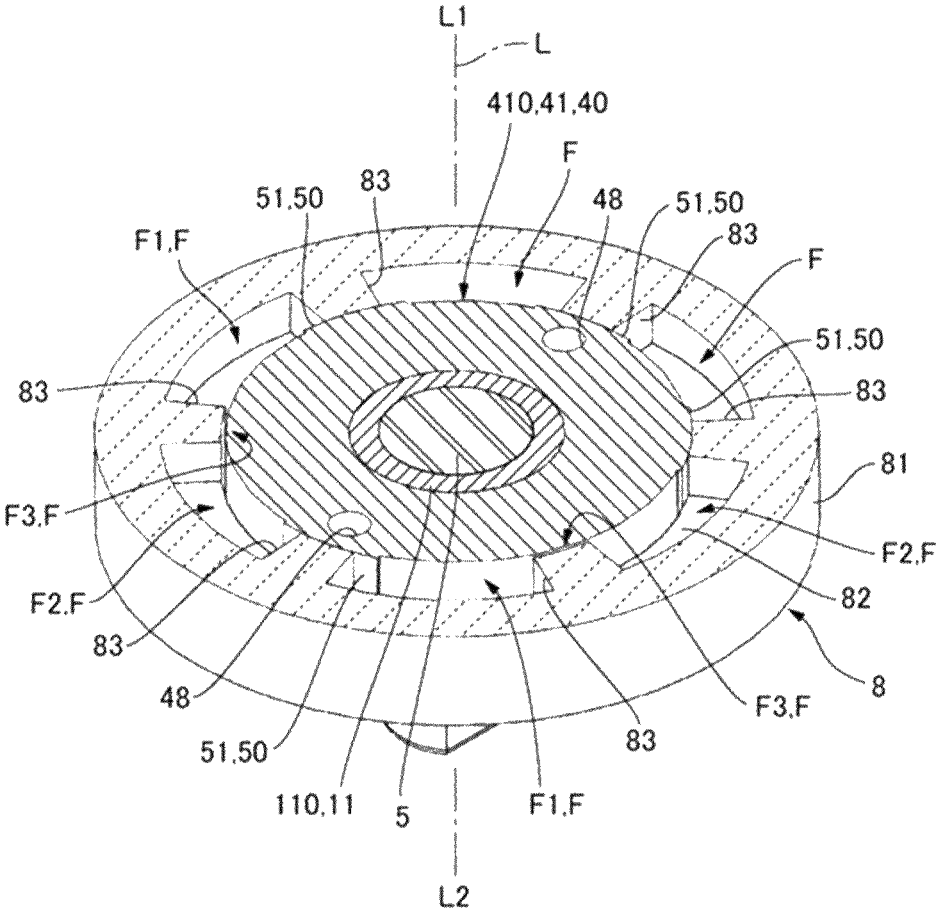
FIG. 9 is a cross-sectional perspective view showing the rotor, the radial bearing and the support shaft which are cut in a plane perpendicular to the rotation axis (view which is cut at the "B-B" position in FIG. 7).

FIG. 3 is a side view showing the rotor 4. FIG. 4 is an exploded perspective view showing the rotor 4 and the radial bearing 11 which are viewed from one side "L1" in the axial direction. FIG. 5 is an exploded perspective view showing the rotor 4 and the radial bearing 11 which are viewed from the other side "L2" in the axial direction. FIG. 6 is a cross-sectional perspective view showing the rotor member 40. FIG. 7 is a partial cross-sectional view showing the rotor 4, the radial bearing 11 and the support shaft 5 which are cut in a plane including the rotation axis "L". FIGS. 8 and 9 are cross-sectional perspective views showing the rotor 4, the radial bearing 11 and the support shaft 5 which are cut in a plane perpendicular to the rotation axis "L". FIG. 8 is a partial cross-sectional view which is cut at the "A-A" position in FIG. 7, and FIG. 9 is a partial cross-sectional view which is cut at the "B-B" position in FIG. 7.

As shown in FIGS. 2 and 5, the rotor member 40 is provided with a circular ring-shaped seat part 42 protruding from the first cylindrical part 41 to an outer side in the radial direction at a separated position from the flange part 45 to the other side "L2" in the axial direction. The first cylindrical part 41 is provided with a magnet holding part 410 which is extended from the seat part 42 to the other side "L2" in the axial direction. The magnet holding part 410 is fitted to an inner side of the drive magnet 8 and holds the drive magnet 8. In this case, the seat part 42 supports an end of the drive magnet 8 on one side "L1" in the axial direction. As shown in FIGS. 2, 3 and 7, an end of the magnet holding part 410 on the other side "L2" in the axial direction is formed with a caulked part 43 which is overlapped with an end on the other side "L2" of the drive magnet 8 from the other side "L2" in the axial direction. The shape of the rotor member 40 shown in FIGS. 4, 5 and 6 is a shape before a tip end part 411 on the other side "L2" of the magnet holding part 410 is crushed to form the caulked part 43.

As shown in FIGS. 4 and 5, the radial bearing 11 is provided with a cylindrical part 110 extended in the axial direction and a large diameter part 111 provided at an end of the cylindrical part 110 on one side "L1" in the axial direction. The rotor member 40 is a resin-molded product, and the radial bearing 11 is fixed to the magnet holding part 410 by insert molding.

As shown in FIGS. 2 and 7, the drive magnet 8 is provided with a second cylindrical part 81 extended in the axial direction and a ring-shaped rib 82 which protrudes to an inner side in the radial direction from an end of the second cylindrical part 81 on the other side "L2" in the axial direction. The second cylindrical part 81 and the ring-shaped rib 82 are connected with each other so as to form an L-shaped cross-sectional shape as a whole. The rotor member 40 and the drive magnet 8 are assembled so that the magnet holding part 410 of the rotor member 40 is inserted into an inner side of the second cylindrical part 81 of the drive magnet 8 and the tip end part 411 of the magnet holding part 410 is fitted to an inside of the ring-shaped rib 82.

As shown in FIGS. 4, 8 and 9, the drive magnet 8 is provided with a plurality of magnet side ribs 83 which protrudes from an inner peripheral face of the second cylindrical part 81 to an inner side in the radial direction. A plurality of the magnet side ribs 83 is arranged in the circumferential direction at constant angular intervals. In this embodiment, the magnet side ribs 83 are disposed at six positions at 60-degree intervals. As shown in FIGS. 4 and 5, an end of the magnet side rib 83 on the other side "L2" in the axial direction is connected with the ring-shaped rib 82. The magnet holding part 410 is fitted to inner sides of the six magnet side ribs 83 which are disposed radially.

As shown in FIG. 4, the rotor member 40 is provided with cut-out parts 420 which are formed by cutting out an outer peripheral edge of the seat part 42 to an inner peripheral side at a plurality of positions separated in the circumferential direction. A center in the circumferential direction of each of the cut-out parts 420 is provided with a recessed part 421 extended in the radial direction. A center in the circumferential direction of the recessed part 421 is provided with a first protruded part 422 which protrudes to the other side "L2" in the axial direction. The first protruded part 422 is connected with an outer peripheral face of the magnet holding part 410 and is extended to an outer edge of the seat part 42. A height in the axial direction of the first protruded part 422 is larger than a depth in the axial direction of the recessed part 421. In this embodiment, the cut-out part 420 and the recessed part 421 are provided at three positions at 120-degree intervals.

As shown in FIG. 4, the drive magnet 8 is alternately provided with three first recessed parts 84 and three gate marks 85 on an end face on one side "L1" in the axial direction of the second cylindrical part 81 at equal angular intervals in the circumferential direction. When the drive magnet 8 is to be fixed to the magnet holding part 410, the end face on one side "L1" in the axial direction of the second cylindrical part 81 is brought into contact with the seat part 42 from the other side "L2" in the axial direction. In this case, each of a plurality of the first protruded parts 422 is fitted to the first recessed part 84 (see FIG. 4) which is formed on the end face on one side "L1" in the axial direction of the second cylindrical part 81 to form a rotation preventing part "E". As a result, rotation of the drive magnet 8 with respect to the rotor member 40 is prevented.

When the drive magnet 8 is assembled to an outer periphery of the magnet holding part 410, the tip end part 411 (see FIGS. 4 and 5) of the magnet holding part 410 on the other side "L2" in the axial direction is protruded to the other side "L2" from an end face on the other side "L2" of the drive magnet 8. When the rotor 4 is to be manufactured, the caulked part 43 is formed by crushing the tip end part 411 of the magnet holding part 410 (see FIGS. 3 and 7). The caulked part 43 is overlapped with an inner circumferential edge of the ring-shaped rib 82 of the drive magnet 8 from the other side "L2" in the axial direction.

In this embodiment, the number of magnetic poles of the drive magnet 8 is 6, and the number of slots of the stator 3 is 9. Therefore, an "N"-pole and an "S"-pole are alternately magnetized by three poles on an outer peripheral face of the drive magnet 8. As described above, the drive magnet 8 is provided with the magnet side ribs 83 at six positions. The position where the magnet side rib 83 is formed can be, for example, set at a position where the magnetic flux density is largest, in other words, at a center in the circumferential direction of each of the magnetic poles.

(Flow Passage for Cooling)

As shown in FIGS. 2 and 7, the rotor 4 in this embodiment is provided with a space in the radial direction between the magnet holding part 410 of the rotor member 40 and the drive magnet 8. The space functions as a flow path groove "F" where a fluid of the pump chamber 20 flows. The flow path groove "F" communicates with a gap "G1" (see FIG. 2) between the drive magnet 8 and the second partition part 62 of the housing 6 through an inflow port 44 (see FIG. 3) provided between the second cylindrical part 81 of the drive magnet 8 and the seat part 42 of the rotor member 40. When a fluid of the pump chamber 20 flows into the flow path groove "F", the drive magnet 8 and the magnet holding part 410 are cooled down and the radial bearing 11 is cooled down through the magnet holding part 410.

As shown in FIG. 3, the inflow port 44 is provided between the second cylindrical part 81 of the drive magnet 8 and the seat part 42 and is opened to an outer side in the radial direction. As described above, the seat part 42 is provided with the recessed part 421 which is recessed to one side "L1" in the axial direction, and the inflow port 44 is formed by an end face of the second cylindrical part 81 on one side "L1" in the axial direction and the recessed part 421. The inflow port 44 is provided at one position each on both sides in the circumferential direction of the rotation preventing part "E" where the first protruded part 422 of the rotor member 40 is fitted to the first recessed part 84 of the drive magnet 8.

As shown in FIGS. 4 and 5, the rotor member 40 is provided with a plurality of rotor member side ribs 50 which are formed on an outer peripheral face of the magnet holding part 410 of the first cylindrical part 41. The rotor member side rib 50 is extended in the axial direction with a constant width. An end of the rotor member side rib 50 on one side "L1" in the axial direction is connected with the seat part 42. In this embodiment, the rotor member side rib 50 includes two types, i.e., a first rib 51 extended to the tip end part 411 on the other side "L2" of the magnet holding part 410, and a second rib 52 whose length in the axial direction is shorter than the first rib 51.

As shown in FIGS. 8 and 9, an outer peripheral face of the magnet holding part 410 is provided with the rotor member side ribs 50 at six positions with 60-degree intervals. The rotor member 40 and the drive magnet 8 are assembled in a state that angular positions of the rotor member side rib 50 and the magnet side rib 83 are coincided with each other by the rotation preventing part "E" in a fitted state. A width in the circumferential direction of the rotor member side rib 50 is larger than that of the magnet side rib 83. The space between the magnet holding part 410 and the drive magnet 8 is partitioned in the circumferential direction by contacting a tip end face of the rotor member side rib 50 with a tip end face of the magnet side rib 83. As a result, the flow path groove "F" extending in the axial direction is formed.

The "R1" direction shown in FIG. 4 is a front side in a rotating direction of the rotor 4, and the "R2" direction is a rear side in the rotating direction of the rotor 4. As shown in FIG. 5, the flow path groove "F" is provided with a first groove part "F1" extended in the axial direction, a second groove part "F2" extended in the axial direction on the rear side "R2" in the rotating direction of the rotor 4 with respect to the first groove part "F1", and a third groove part "F3" which is extended in the circumferential direction and connects end parts on the other side "L2" in the axial direction of the first groove part "F1" and the second groove part "F2" with each other. In other words, a part of the flow path groove "F" forms a substantially U-shaped groove which is turned once in the axial direction.

As shown in FIG. 5, the third groove part "F3" is extended in the circumferential direction on the other side "L2" in the axial direction of the second rib 52. The magnet side rib 83 abutted on the second rib 52 is extended to the other side "L2" with respect to the second rib 52. Therefore, a clearance which is the third groove part "F3" is formed between a tip end part of the magnet side rib 83 which is abutted on the second rib 52 and an outer peripheral face of the magnet holding part 410 (see FIG. 9).

As shown in FIG. 5, the recessed part 421 which forms the inflow port 44 is provided at an angular position coincided with the first groove part "F1". In the first groove part "F1", the second groove part "F2" and the third groove part "F3" which forms a U-shaped flow passage as a whole, the third groove part "F3" and the second groove part "F2" are provided on the rear side "R2" in the rotating direction with respect to the first groove part "F1" which communicates with the inflow port 44 (recessed part 421). Therefore, when the rotor 4 is rotated in the "R1" direction, a fluid of the first groove part "F1" is moved to the "R2" direction side by an inertial force and flows the third groove part "F3" and the second groove part "F2" and a flow in the "D"-direction shown in FIG. 5 occurs. As a result, an inside of the first groove part "F1" becomes negative pressure and thus, a fluid flows into the first groove part "F1" through the inflow port 44. Therefore, while the rotor 4 is being rotated, the fluid continues to flow the flow path groove "F" in the "D" direction shown in FIG. 5.

An outer side portion in the radial direction of the seat part 42 in the second groove part "F2" is a flat face which supports the drive magnet 8 and thus, a wide opening part such as the inflow port 44 is not formed on an outer side in the radial direction of the second groove part "F2". Therefore, in the first groove part "F1", the second groove part "F2" and the third groove part "F3" which form a "U"-shaped flow passage, a differential pressure is generated between the inflow side and the outflow side, and the fluid is easily flowed.

As shown in FIG. 8, the six flow path grooves "F" partitioned by the six rotor member side ribs 50 and the six magnet side ribs 83 extended in the axial direction are provided between the magnet holding part 410 and the drive magnet 8. In this embodiment, four of the six rotor member side ribs 50 are the first ribs 51 which are extended to a tip end part on the other side "L2" of the magnet holding part 410, and the remaining two are the second ribs 52 whose length in the axial direction is shorter than the first rib 51. The first rib 51 and the second rib 52 are alternately disposed in the circumferential direction. Therefore, four of the six flow path grooves "F" form, as described above, the flow passages connected in a U-shape through the third groove part "F3" formed on the other side "L2" of the second rib 52, but the remaining two flow path grooves "F" form the flow passage extended in a straight line shape from the seat part 42 to the ring-shaped rib 82.

(Flow Passage for Cooling Bearing)

As shown in FIG. 6, the first cylindrical part 41 of the rotor member 40 is provided with a connection part 412 which is extended in the axial direction between the flange part 45 and the seat part 42. One side "L1" in the axial direction of a first space "H" inside the connection part 412 is opened at a center of the flange part 45, and the first space "H" communicates with the pump chamber 20. Further, the first space "H" communicates with the pump chamber 20 through a through-hole 46 penetrating through the connection part 412. The through-hole 46 is provided at two positions on an opposite side to each other in the radial direction. As shown in FIG. 2, an end of the support shaft 5 is extended to the first space "H" and is inserted into the cylindrical part 28 which is disposed in the first space "H". One part of the large diameter part 111 of the radial bearing 11 is disposed in the first space "H" and is abutted on the thrust bearing 12.

An inner peripheral face of the connection part 412 is provided with flow path grooves 47 of a circular arc-shaped cross section which are extended in the axial direction. Each of the flow path grooves 47 communicates with a bearing cooling flow passage 48 which penetrates through the magnet holding part 410 in the axial direction. The flow path groove 47 and the bearing cooling flow passage 48 are provided at two positions on an opposite side to each other in the radial direction. An end on the other side in the axial direction of the bearing cooling flow passage 48 communicates with a space "G2" (see FIG. 2) between the bottom wall 63 of the housing 6 and the magnet holding part 410. Therefore, a fluid of the pump chamber 20 flowed from an outer peripheral side of the through-hole 46 and a side of the flange part 45 is flowed through the bearing cooling flow passage 48 and thereby, the radial bearing 11 and the magnet holding part 410 are cooled down.

Principal Operation-Effects in this Embodiment

As described above, the pump device 1 in this embodiment includes the motor 10 having the rotor 4 and the stator 3 surrounding an outer peripheral side of the rotor 4 and the impeller 25 which is, when a direction along the rotation axis "L" of the rotor 4 is defined as an axial direction, disposed in the pump chamber 20 provided on one side "L1" in the axial direction with respect to the stator 3 and is integrally rotated with the rotor 4. The rotor 4 includes the rotor member 40 provided with the first cylindrical part 41 extended in the axial direction and the drive magnet 8 surrounding an outer periphery of the first cylindrical part 41, and the radial bearing 11 is held on an inner side of the first cylindrical part 41. The drive magnet 8 is provided with the second cylindrical part 81 which surrounds an outer periphery of the first cylindrical part 41 and is extended in the axial direction, and the ring-shaped rib 82 which protrudes from an end on the other side "L2" in the axial direction of the second cylindrical part 81 to an inner side in the radial direction. The rotor member 40 is provided with the seat part 42, which protrudes from the first cylindrical part 41 to an outer side in the radial direction and supports an end on one side "L1" in the axial direction of the second cylindrical part 81, and the caulked part 43 which is enlarged from an end on the other side "L2" in the axial direction of the first cylindrical part 41 to an outer side in the radial direction and is overlapped with the ring-shaped rib 82 from the other side "L2" in the axial direction.

According to this embodiment, the drive magnet 8 is held between the seat part 42 provided in the first cylindrical part 41 of the rotor member 40 and the caulked part 43. The drive magnet 8 is provided with the ring-shaped rib 82 which protrudes to an inner side in the radial direction at its end on the tip end side of the first cylindrical part 41 (caulked part 43 side). As described above, when the drive magnet 8 is provided with a protruding portion (ring-shaped rib 82) which protrudes to an inner peripheral side instead of forming a simple cylindrical shape, even when a length in the axial direction of the drive magnet 8 is shortened, its volume is secured and a necessary magnetic attracting force can be secured. Further, the ring-shaped rib 82 is provided at an end on a side where the caulked part 43 is provided and thus, a width in the radial direction of an end face which receives the caulked part 43 is large. Therefore, the caulked part 43 is less likely to protrude from the drive magnet 8 to an outer side in the radial direction and thus, reduction of shape accuracy of the rotor 4 due to thermal caulking can be suppressed.

In this embodiment, a space is provided in the radial direction between the first cylindrical part 41 and the second cylindrical part 81, and the space functions as the flow path groove "F" where a fluid of the pump chamber 20 flows. The other side "L2" in the axial direction of the flow path groove "F" is closed by the ring-shaped rib 82 and the caulked part 43. According to this structure, the flow path groove "F" has a depth (dimension in the radial direction) corresponding to a protruded dimension of the ring-shaped rib 82 and thus, a capacity of the flow path groove "F" can be secured and much fluid can flow between the drive magnet 8 and the first cylindrical part 41. Therefore, a cooling effect of the radial bearing 11 which is held inside the first cylindrical part 41 and a cooling effect of the drive magnet 8 can be enhanced. Accordingly, reduction in a lifetime of the component and reduction in magnetic characteristics of the drive magnet 8 due to a high temperature can be suppressed.

In this embodiment, an inner peripheral face of the second cylindrical part 81 is disposed in the circumferential direction with a plurality of the magnet side ribs 83 which protrude to an inner side in the radial direction and are extended in the axial direction, and a space between the magnet side ribs 83 adjacent to each other in the circumferential direction functions as the flow path groove "F". According to this structure, the first cylindrical part 41 can be fitted to an inner side of the magnet side ribs 83 which are disposed radially and thus, the flow path groove "F" having a large capacity is secured and the drive magnet 8 can be attached with a high degree of accuracy. Further, the second cylindrical part 81 can be reinforced by the magnet side ribs 83 and thus, strength of the drive magnet 8 can be increased.

In this embodiment, an end on the other side "L2" in the axial direction of the magnet side rib 83 is connected with the ring-shaped rib 82. As a result, the second cylindrical part 81 and the ring-shaped rib 82 are connected with each other through the magnet side ribs 83 and thus, strength of the drive magnet 8 can be increased.

In this embodiment, an outer peripheral face of the first cylindrical part 41 is provided in the circumferential direction with a plurality of the rotor member side ribs 50 which protrude to an outer side in the radial direction and are extended in the axial direction. A tip end face of the magnet side rib 83 is abutted on a tip end face of the rotor member side rib 50 and thereby the flow path groove "F" is partitioned in the circumferential direction. As described above, when a rib is also formed in the rotor member 40 in addition to the drive magnet 8, a depth (dimension in the radial direction) of the flow path groove "F" can be further increased. Therefore, a capacity of the flow path groove "F" can be secured.

In this embodiment, the inflow port 44 communicating with the flow path groove "F" is provided between the seat part 42 and the second cylindrical part 81 and thus, a fluid of the pump chamber 20 is capable of flowing into the flow path groove "F" through the gap "G1" on an outer peripheral side of the drive magnet 8.

In this embodiment, the flow path groove "F" is provided with the first groove part "F1" extended in the axial direction, the second groove part "F2" extended in the axial direction on a rear side in a rotating direction of the rotor 4 ("R2" direction side) with respect to the first groove part "F1", and the third groove part "F3" which is extended in the circumferential direction and connects the other side "L2" ends in the axial direction of the first groove part "F1" and the second groove part "F2" with each other. The inflow port 44 communicates with the first groove part "F1". In other words, the flow path groove "F" in this embodiment is formed by connecting the first groove part "F1" and the second groove part "F2" extended in the axial direction with each other through the third groove part "F3" in a shape that is turned once (U-shape) in the axial direction. As a result, in comparison with a case that a simple straight-shaped flow passage is provided, an area contacting with a fluid is capable of widening and thus, a cooling effect can be enhanced. Further, when the rotor 4 is rotated, a fluid flows to a rear side in the rotating direction ("R2" direction side) by an inertial force and thus, the inflow port 44 side becomes negative pressure and the fluid of the pump chamber 20 continues to flow in. Therefore, a cooling effect can be enhanced.

In this embodiment, the seat part 42 is provided with the recessed part 421 which is recessed to one side "L1" in the axial direction, and the inflow port 44 is a space between a bottom face of the recessed part 421 and an end face on one side "L1" in the axial direction of the second cylindrical part 81. Therefore, without providing a through-hole in a component, the inflow port 44 which communicates an outer peripheral side of the drive magnet 8 with its inner peripheral side can be formed with a simple structure.

In this embodiment, the first protruded part 422 protruding from the bottom face of the recessed part 421 is fitted to the first recessed part 84 provided on an end face of the drive magnet 8, and portions of the recessed part 421 on both sides in the circumferential direction of the first protruded part 422 form two inflow ports 44. According to this structure, the rotation preventing part "E" for preventing relative rotation of the drive magnet 8 to the rotor member 40 can be provided. Further, an angular position of the inflow port 44 with respect to the drive magnet 8 can be aligned and thus, the inflow port 44 can be provided at an appropriate angular position.

In this embodiment, the impeller 25 is provided with the flange part 45, which is provided at an end on one side "L1" in the axial direction of the rotor member 40, and the blade wheel 24 which is fixed to the flange part 45 from one side "L1" in the axial direction. The first cylindrical part 41 is provided with the connection part 412, which is extended in the axial direction between the flange part 45 and the seat part 42, and the magnet holding part 410 which is fitted to an inner side of the drive magnet 8, and the radial bearing 11 is held on an inner side of the magnet holding part 410. An inner side of the connection part 412 is structured to be the first space "H" through which a fluid of the pump chamber 20 flows through the through-hole 46 penetrating the connection part 412 in the radial direction, and the first space "H" communicates with the bearing cooling flow passage 48 which penetrates through the magnet holding part 410 in the axial direction. According to this structure, a fluid of the pump chamber 20 is capable of flowing into the bearing cooling flow passage 48 from a position different from the gap "G1" on an outer peripheral side of the drive magnet 8 (from a center of the flange part 45). Therefore, a cooling effect can be enhanced.

Other Embodiments

The present invention may include an embodiment in which the rotor 4 is provided with no flow path groove "F" between the drive magnet 8 and the magnet holding part 410. In other words, the present invention includes a structure that an outer peripheral face of the magnet holding part 410 is tightly contacted with an inner peripheral face of the second cylindrical part 81 of the drive magnet 8 and has no space between the drive magnet 8 and the magnet holding part 410.

Embodiments of the present invention may be structured as follows.

(1) A pump device including a motor having a rotor and a stator surrounding an outer peripheral side of the rotor, and an impeller which is, when a direction along a rotation axis of the rotor is defined as an axial direction, disposed in a pump chamber provided on one side in the axial direction with respect to the stator and is integrally rotated with the rotor. The rotor includes a rotor member provided with a first cylindrical part extending in the axial direction and a drive magnet surrounding an outer periphery of the first cylindrical part, and a radial bearing is held on an inner side of the first cylindrical part. The drive magnet is provided with a second cylindrical part, which surrounds an outer periphery of the first cylindrical part and extends in the axial direction, and a ring-shaped rib which protrudes from an end on the other side in the axial direction of the second cylindrical part to an inner side in a radial direction. The rotor member is provided with a seat part which protrudes from the first cylindrical part to an outer side in the radial direction and supports an end on one side in the axial direction of the second cylindrical part, and a caulked part which is enlarged from an end on the other side in the axial direction of the first cylindrical part to an outer side in the radial direction and is overlapped with the ring-shaped rib from the other side in the axial direction.

(2) The pump device described in the above-mentioned structure (1), where a space in the radial direction is provided between the first cylindrical part and the second cylindrical part, and the space functions as a flow path groove in which a fluid of the pump chamber flows, and the other side in the axial direction of the flow path groove is closed by the ring-shaped rib.

(3) The pump device described in the above-mentioned structure (2), where an inner peripheral face of the second cylindrical part is provided in a circumferential direction with a plurality of magnet side ribs which protrude to an inner side in the radial direction and extend in the axial direction, and a space between the magnet side ribs adjacent to each other in the circumferential direction functions as the flow path groove.

(4) The pump device described in the above-mentioned structure (3), where an end on the other side in the axial direction of the magnet side rib is connected with the ring-shaped rib.

(5) The pump device described in the above-mentioned structure (3) or (4), where an outer peripheral face of the first cylindrical part is provided in a circumferential direction with a plurality of rotor member side ribs which protrude to an outer side in the radial direction and extend in the axial direction, and a tip end face of the magnet side rib contacts with a tip end face of the rotor member side rib and thereby, the flow path groove is partitioned in the circumferential direction.

(6) The pump device described in one of the above-mentioned structures (2) through (5), where an inflow port communicating with the flow path groove is provided between the seat part and the second cylindrical part.

(7) The pump device described in the above-mentioned structure (6), where the flow path groove is provided with a first groove part extending in the axial direction, a second groove part extending in the axial direction on a rear side in a rotating direction of the rotor with respect to the first groove part, and a third groove part which extends in a circumferential direction and connects ends on the other side in the axial direction of the first groove part and the second groove part with each other, and the inflow port communicate with the first groove part.

(8) The pump device described in the above-mentioned structure (6) or (7), where the seat part is provided with a recessed part which is recessed to one side in the axial direction, and the inflow port is a space between a bottom face of the recessed part and an end face on one side in the axial direction of the second cylindrical part.

(9) The pump device described in the above-mentioned structure (8), where a first protruded part protruding from a bottom face of the recessed part is fitted to a first recessed part provided on an end face of the drive magnet and thereby, a rotation preventing part is structured for preventing relative rotation of the drive magnet to the rotor member, and portions of the recessed part on both sides in the circumferential direction of the first recessed part form two inflow ports adjacent to the rotation preventing part in the circumferential direction.

(10) The pump device described in one of the above-mentioned structures (1) through (9), where the impeller is provided with a flange part provided at an end on one side in the axial direction of the rotor member and a blade wheel fixed to the flange part from one side in the axial direction, the first cylindrical part is provided with a connection part extending in the axial direction between the flange part and the seat part and a magnet holding part fitted to an inner side of the drive magnet, the radial bearing is held on an inner side of the magnet holding part, an inside of the connection part is a first space into which a fluid of the pump chamber flows through a through-hole penetrating through the connection part in the radial direction, and the first space communicates with a bearing cooling flow passage which is penetrated through the magnet holding part in the axial direction.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A pump device, comprising:

a motor having a rotor and a stator surrounding an outer peripheral side of the rotor; and an impeller which is, when a direction along a rotation axis of the rotor is defined as an axial direction, disposed in a pump chamber provided on one side in the axial direction with respect to the stator and is integrally rotated with the rotor;

wherein the rotor comprises a rotor member provided with a first cylindrical part extending in the axial direction and a drive magnet surrounding an outer periphery of the first cylindrical part;

a radial bearing is held on an inner side of the first cylindrical part;

the drive magnet comprises a second cylindrical part, which surrounds an outer periphery of the first cylindrical part and extends in the axial direction, and a ring-shaped rib which protrudes from an end on an other side in the axial direction of the second cylindrical part to an inner side in a radial direction;

the rotor member comprises a seat part which protrudes from the first cylindrical part to an outer side in the radial direction and supports an end on one side in the axial direction of the second cylindrical part, and a caulked part which is enlarged from an end on the other side in the axial direction of the first cylindrical part to an outer side in the radial direction and is overlapped with the ring-shaped rib from the other side in the axial direction;

a space in the radial direction is provided between the first cylindrical part and the second cylindrical part;

the space functions as a flow path groove in which a fluid of the pump chamber flows; and the flow path groove is closed on the other side in the axial direction by the ring-shaped rib and the caulked part.

2. The pump device according to claim 1, wherein an inner peripheral face of the second cylindrical part is provided in a circumferential direction with a plurality of magnet side ribs which protrude to an inner side in the radial direction and extend in the axial direction, and a space between the magnet side ribs adjacent to each other in the circumferential direction functions as the flow path groove.

3. The pump device according to claim 2, wherein an end on the other side in the axial direction of a magnet side rib of the plurality of magnet side ribs is connected with the ring-shaped rib.

4. The pump device according to claim 2, wherein an outer peripheral face of the first cylindrical part is provided in the circumferential direction with a plurality of rotor member side ribs which protrude to an outer side in the radial direction and extend in the axial direction, and a tip end face of a magnet side rib of the plurality of magnet side ribs contacts with a tip end face of the rotor member side rib and thereby, the flow path groove is partitioned in the circumferential direction.

5. The pump device according to claim 1, wherein an inflow port communicating with the flow path groove is provided between the seat part and the second cylindrical part.

6. The pump device according to claim 5, wherein the flow path groove comprises a first groove part extending in the axial direction, a second groove part extending in the axial direction on a rear side in a rotating direction of the rotor with respect to the first groove part, and a third groove part which extends in a circumferential direction and connects ends on the other side in the axial direction of the first groove part and the second groove part with each other, and the inflow port communicates with the first groove part.

7. The pump device according to claim 5, wherein the seat part comprises a recessed part which is recessed to one side in the axial direction, and the inflow port is a gap space between a bottom face of the recessed part and an end face on one side in the axial direction of the second cylindrical part.

8. The pump device according to claim 7, wherein a first protruded part protruding from the bottom face of the recessed part is fitted to a first recessed part provided on an end face of the drive magnet, and portions of the recessed part on both sides in a circumferential direction of the first protruded part form the inflow ports at two positions.

9. A pump device, comprising:

a motor having a rotor and a stator surrounding an outer peripheral side of the rotor; and an impeller which is, when a direction along a rotation axis of the rotor is defined as an axial direction, disposed in a pump chamber provided on one side in the axial direction with respect to the stator and is integrally rotated with the rotor;

wherein the rotor comprises a rotor member provided with a first cylindrical part extending in the axial direction and a drive magnet surrounding an outer periphery of the first cylindrical part;

a radial bearing is held on an inner side of the first cylindrical part;

the drive magnet comprises a second cylindrical part, which surrounds an outer periphery of the first cylindrical part and extends in the axial direction, and a ring-shaped rib which protrudes from an end on an other side in the axial direction of the second cylindrical part to an inner side in a radial direction;

the rotor member comprises a seat part which protrudes from the first cylindrical part to an outer side in the radial direction and supports an end on one side in the axial direction of the second cylindrical part, and a caulked part which is enlarged from an end on the other side in the axial direction of the first cylindrical part to an outer side in the radial direction and is overlapped with the ring-shaped rib from the other side in the axial direction;

the impeller comprises a flange part provided at an end on one side in the axial direction of the rotor member and a blade wheel fixed to the flange part from one side in the axial direction, the first cylindrical part comprises a connection part extending in the axial direction between the flange part and the seat part and a magnet holding part fitted to an inner side of the drive magnet, the radial bearing is held on an inner side of the magnet holding part, an inside of the connection part is a first space into which a fluid of the pump chamber flows through a through-hole penetrating through the connection part in the radial direction, and the first space communicates with a bearing cooling flow passage which is penetrated through the magnet holding part in the axial direction.

* * * * *